US006205717B1

(12) United States Patent
Shall et al.

(10) Patent No.: US 6,205,717 B1
(45) Date of Patent: Mar. 27, 2001

(54) BUNKER CONSTRUCTION

(75) Inventors: John S. Shall, Falls Church; Kim Truong, Vienna, both of VA (US)

(73) Assignee: Freyssinet International (STUP), Cedex (FR)

( * ) Notice: Subject to any disclaimer, the term of this patent is extended or adjusted under 35 U.S.C. 154(b) by 0 days.

(21) Appl. No.: 09/547,219

(22) Filed: Apr. 11, 2000

(51) Int. Cl.[7] ..... E02D 27/00

(52) U.S. Cl. ..... 52/89; 52/169.6; 52/294; 52/299

(58) Field of Search ..... 52/86–89, 169.1, 52/169.6, 292–295, 299; 405/124–127

(56) References Cited

U.S. PATENT DOCUMENTS 1,223,266 * 4/1917 Dyer ..... 52/89 X
2,755,630 * 7/1956 Freyssinet ..... 52/169.6
3,173,387 * 3/1965 Cree, Jr. ..... 52/169.6
4,686,804 * 8/1987 Smith ..... 52/169.6
5,685,115 * 11/1997 Colfer ..... 52/294 X
6,032,421 * 3/2000 Yamada ..... 52/169.6 X

FOREIGN PATENT DOCUMENTS

539978 * 10/1941 (GB) ..... 52/169.6

* cited by examiner

*Primary Examiner*—Richard Chilcot
(74) *Attorney, Agent, or Firm*—Banner & Witcoff, Ltd.

(57) ABSTRACT

A bunker construction is comprised of precast arch elements which form a semicircular roof of the bunker by engaging cast-in-place footings. A front and back plate cover the front and back of the enclosure defined by the arch elements. A crown element along the apex of the arch and footing blocks at the bottom sides of the arch along the footing facilitate a lightning protection system. Precast concrete panels form lateral sides of the front of the bunker construction and compacted earth coacts with steel stabilizing elements associated with the precast panels and the front plate of the bunker. The entire bunker exterior is covered with compacted earth thereby forming a bunker construction with enhanced structural integrity due to the mechanically stabilized earth in combination with the precast arch elements and front panel members.

11 Claims, 4 Drawing Sheets

FIG. 6
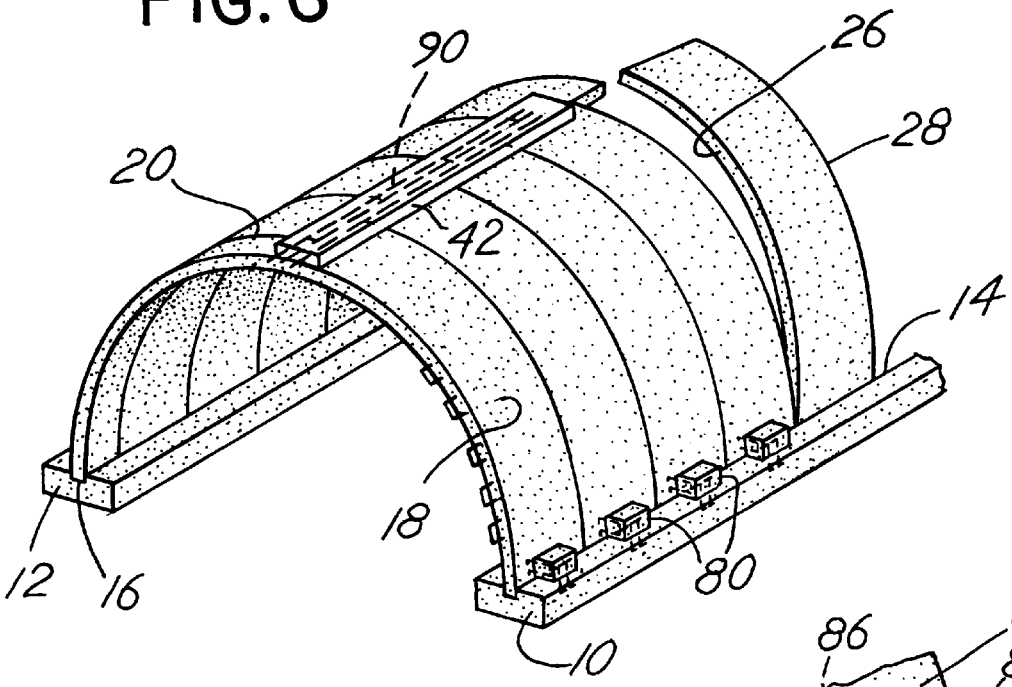
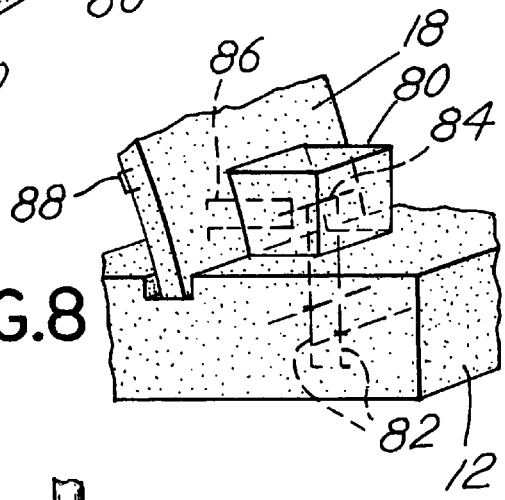
FIG.8
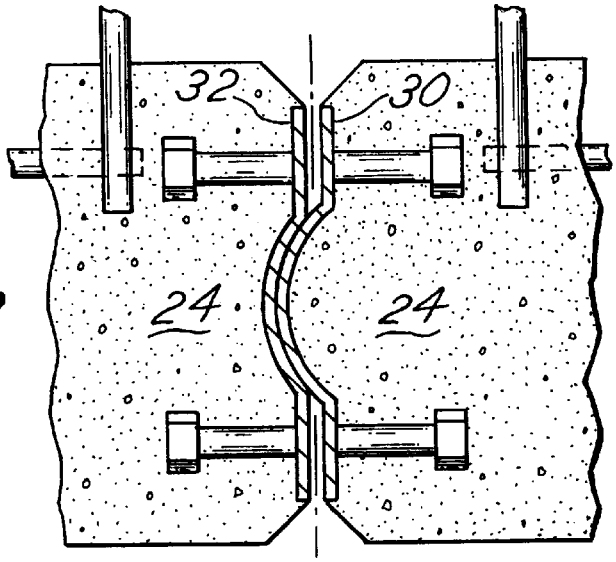
FIG.7

BUNKER CONSTRUCTION

BACKGROUND OF THE INVENTION

This invention relates to a bunker construction and, more particularly, to a bunker construction of the type which may be used for the storage of munitions and other explosive or dangerous materials.

Heretofore, it has been a usual practice to store munitions and other explosive materials in bunkers, for example, underground excavations, cast in place concrete enclosures or reinforced concrete enclosures covered with earth. The cost of fabricating or constructing such bunker facilities is often extremely high because of the rigorous safety factor requirements. Additionally, such construction is very time consuming. Thus, there has remained the need to develop improved methods for making or constructing bunkers quickly. Another need and desire is to provide a bunker construction which may be quickly assembled on a site of immediate need.

The key element of the invention is the manner in which the prefabricated components are designed and assembled. The innovative design provides a cost-effective solution for meeting Government safety requirements, specifically electrical continuity or lightning protection.

SUMMARY OF THE INVENTION

Briefly, the present invention comprises a bunker construction which is, in part, made from precast concrete components thereby reducing cast-in-place concrete requirements. The bunker construction includes multiple, side-by-side, precast concrete arch elements which are assembled in combination with footings and which engage each other along a center line at the apex of the semicircular roof formed by the arch elements. Front and back plates (cast-in-place concrete walls), as well as a bottom plate (cast-in-place floor and footings) in combination with the arch elements form the internal enclosure of the bunker. The precast arch elements are connected, in part, to the bottom plate by a concrete block. The concrete blocks, at least one block per precast arch unit, comprise elements containing reinforcement bars which interconnect the bottom plate with the arch units. Similarly, the precast arch elements are connected to each opposing arch element along the apex by a continuous crown element. The continuous crown element comprises an element containing reinforcement bars which tie opposing arch elements together. These interconnections, between the arch elements and the bottom plate, and the arch elements to each other, provide the effect of a Faraday Cage which provides electrical continuity to thereby avoid discharge of any static electricity present in the environment of the bunker, and particularly to provide protection from the effects of lightning.

The front plate of the bunker is defined by a vertical cast-in-place concrete wall with a rectangle protective door. To each side of the front plate a wing wall is constructed. Each of the two wing walls is comprised of a series of precast concrete panels of a mechanically stabilized earthen structure, the purpose of which is to retain the earth over and around the bunker. This earth is placed, compacted, and then stabilized by steel strips attached to the precast concrete panels, and this further enhances the integrity and protection of the bunker.

Thus, it is an object of the invention to find an improved bunker construction made, at least in part, from prefabricated construction elements, which when installed, provides adequate lightning protection.

It is a further object of the invention to provide a bunker construction having improved or enhanced performance capabilities under catastrophic conditions.

Another object of the invention is to provide a bunker construction which can be quickly and easily assembled from various precast concrete elements with construction equipment that is highly mobile.

Yet another object of the invention is to provide a bunker construction comprised of a series of almost semicircular, precast arch elements that may be easily and quickly assembled at various sites and with the minimum amount of construction equipment.

These and other objects, advantages and features of the invention will be set forth in the detailed description which follows.

BRIEF DESCRIPTION OF THE DRAWING

In the detailed description which follows, reference will be made to the drawing and comprised of the following figures:

FIG. 6 is an isometric view of partially assembled bunker construction;

FIG. 7 is an enlarged cross sectional view of the arch joint construction associated with the precast arch elements forming the semicircular roof of the bunker construction; and FIG. 8 is an isometric detail view of footing blocks which include conductive bars that connect to bars in the arch members and footing to provide electrical continuity in the bunker.

DESCRIPTION OF THE PREFERRED EMBODIMENT

Figure 1:
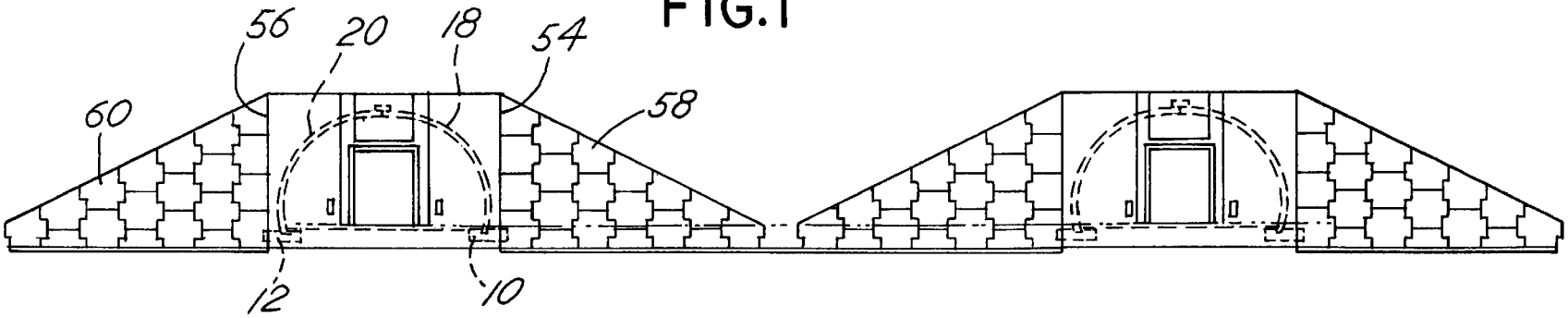
FIG. 1 is a front elevation of a bunker construction of the invention.

Referring to the figures, the bunker construction of the present invention is comprised of first and second generally parallel, cast in place footings 10 and 12. Each footing 10 and 12 is cast on a planar surface and includes a top groove or channel 14 and 16 respectively. The parallel grooves 14 and 16 are of an adequate depth and shape to receive and hold the bottom ends of arch elements as will be described below.

Precast, quarter quasi semicircular arch elements 18 and 20 each have a bottom end 22 and a top end 24. The precast arch elements have spaced lateral sides 26 and 28. The arch elements 18, 20 are arranged with their top ends 24 in opposed or face to face relationship such as depicted in FIG. 7. The top ends 24 of each arch element 18, 20 include a formed end plate 30 and 32. The end plates 30 and 32 are complimentary and keyed one to the other as depicted in FIG. 7. In this manner, when the top ends 24 of the arch elements 18, 20 are engaged, they align along axis 33 and will not slip from engagement one with the other. The particular complimentary plates 30 and 32 depicted in FIG. 7 are not a limiting feature of the invention, though the semicircular engaging shapes thereof are preferred. The plates 30 and 32 are preferably fabricated from steel and form a part of the form for the precast arch elements 18, 20. As noted, they engage along center line axis 33 of the formed arch elements 18, 20 which forms the roof of the enclosure.

In practice, the arch elements 18 and 20 are quarter, quasi semicircular elements and have a common width, except for elements at the opposite ends of the formed roof enclosure. That is, the arch elements at the formed opposite ends have a width approximately one-half the width of the opposed arch element so that the opposing arch elements will be offset with respect to each other as depicted, for example, in FIG. 2. In this manner, the structural integrity of the enclosure is enhanced. Note curved shapes other than quarter circular shaped arch elements may be used, e.g., partial elliptical, more than quarter circular, partial hyperbolic, etc.

A cast-in-place end plate or backside plate 40 is fitted against the inside or backside end of the assembled arch elements 18, 20. The center line axis 33 at the apex of the arch elements 18, 20 where the opposed arch elements 18, 20 are engaged, includes a cast-in-place crown element 42. This crown element 42 provides the longitudinal structural and electrical continuity between either side of the axis 33. A cast-in-place bottom plate (floor) 44 forms the bottom enclosure. Note that the floor 44 adjoins the footings 12 and 14.

Figure 2:
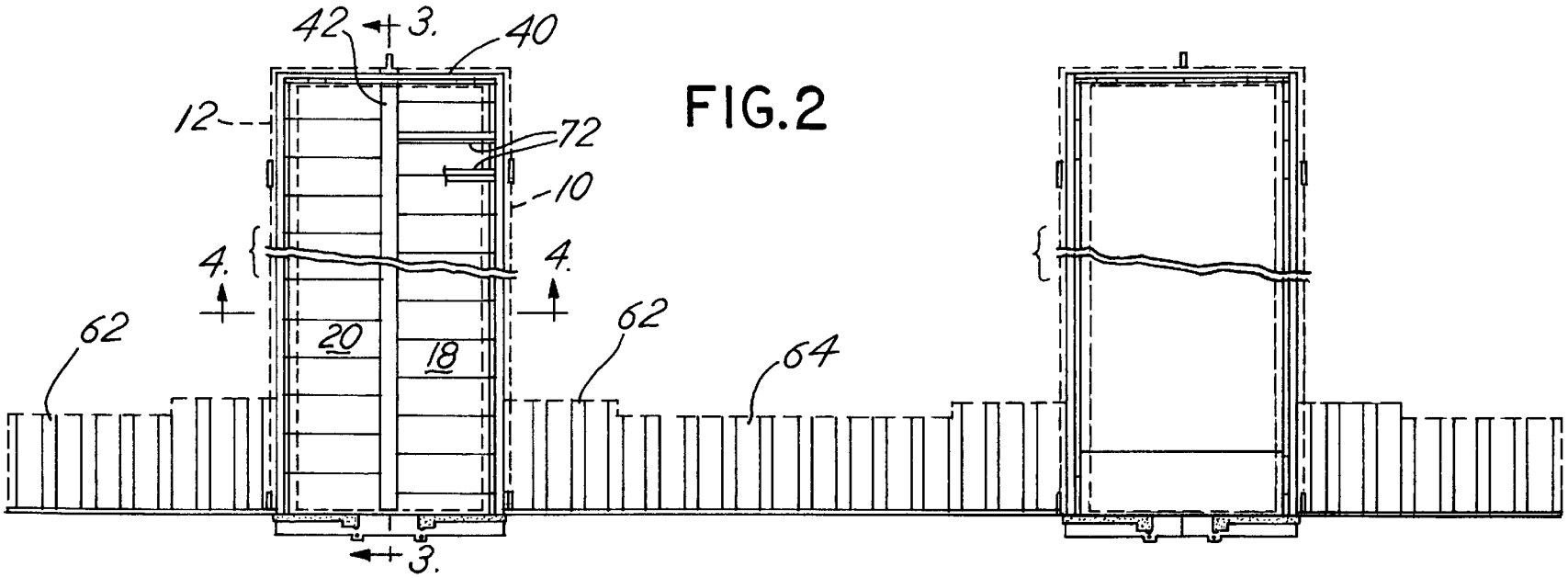
FIG. 2 is a top plan view of the bunker construction of FIG. 1.
Figure 3:
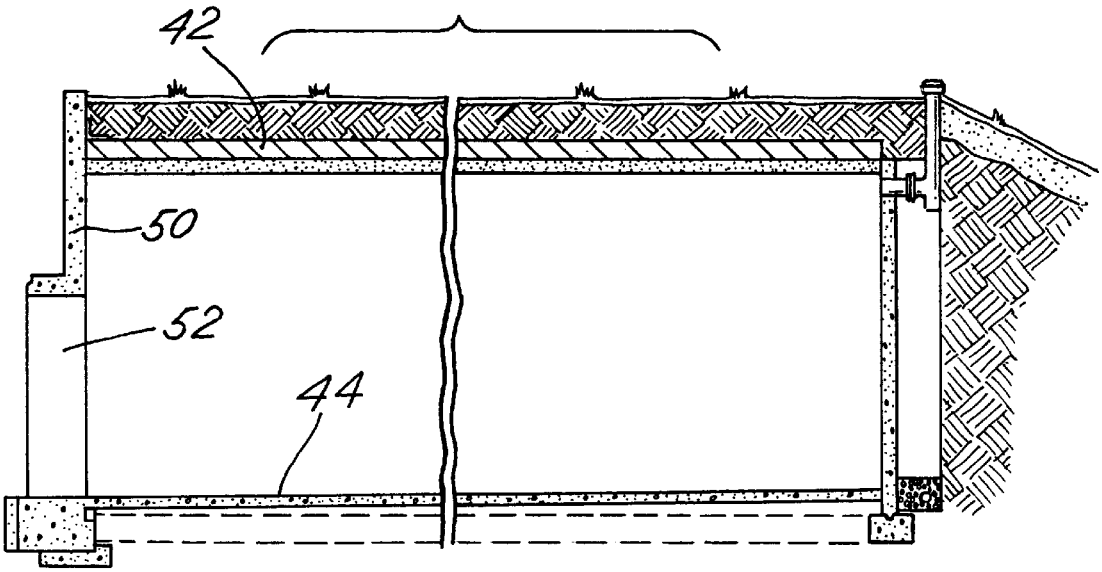
FIG. 3 is a section of the bunker construction of FIG. 2 taken along the line 3—3.
Figure 5:
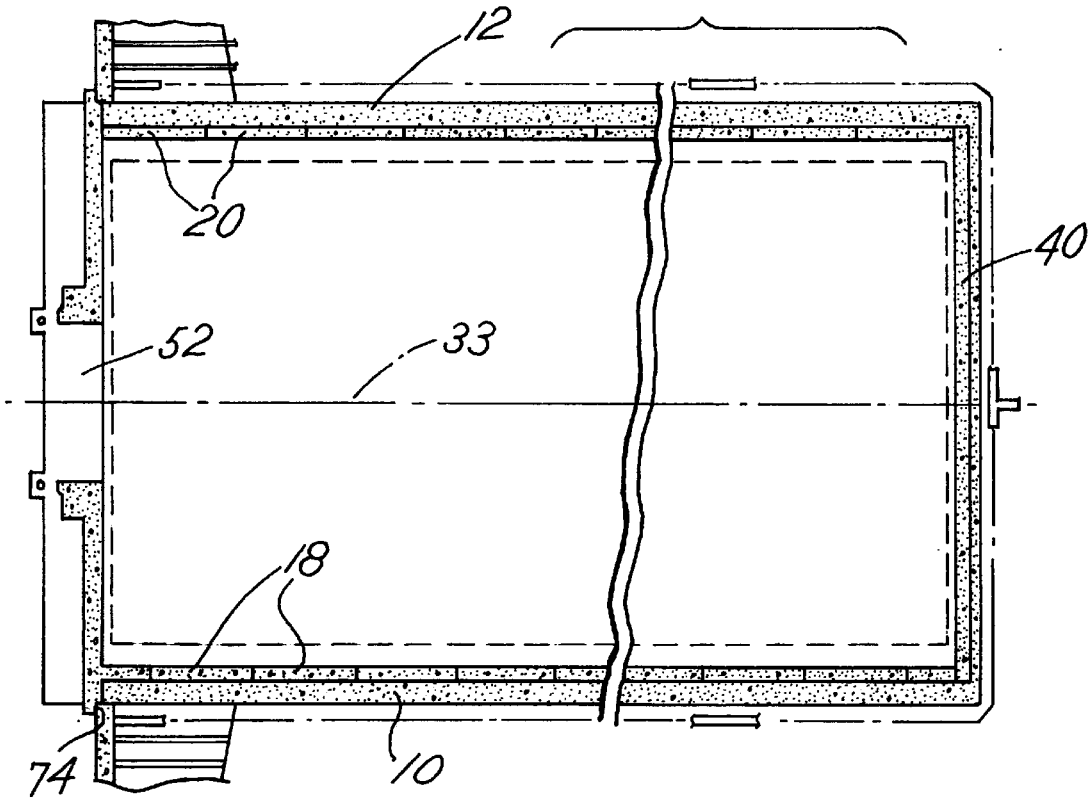
FIG. 5 is a sectional plan view of the bunker construction of FIG. 4 taken along the line 5—5.
Figure 4:
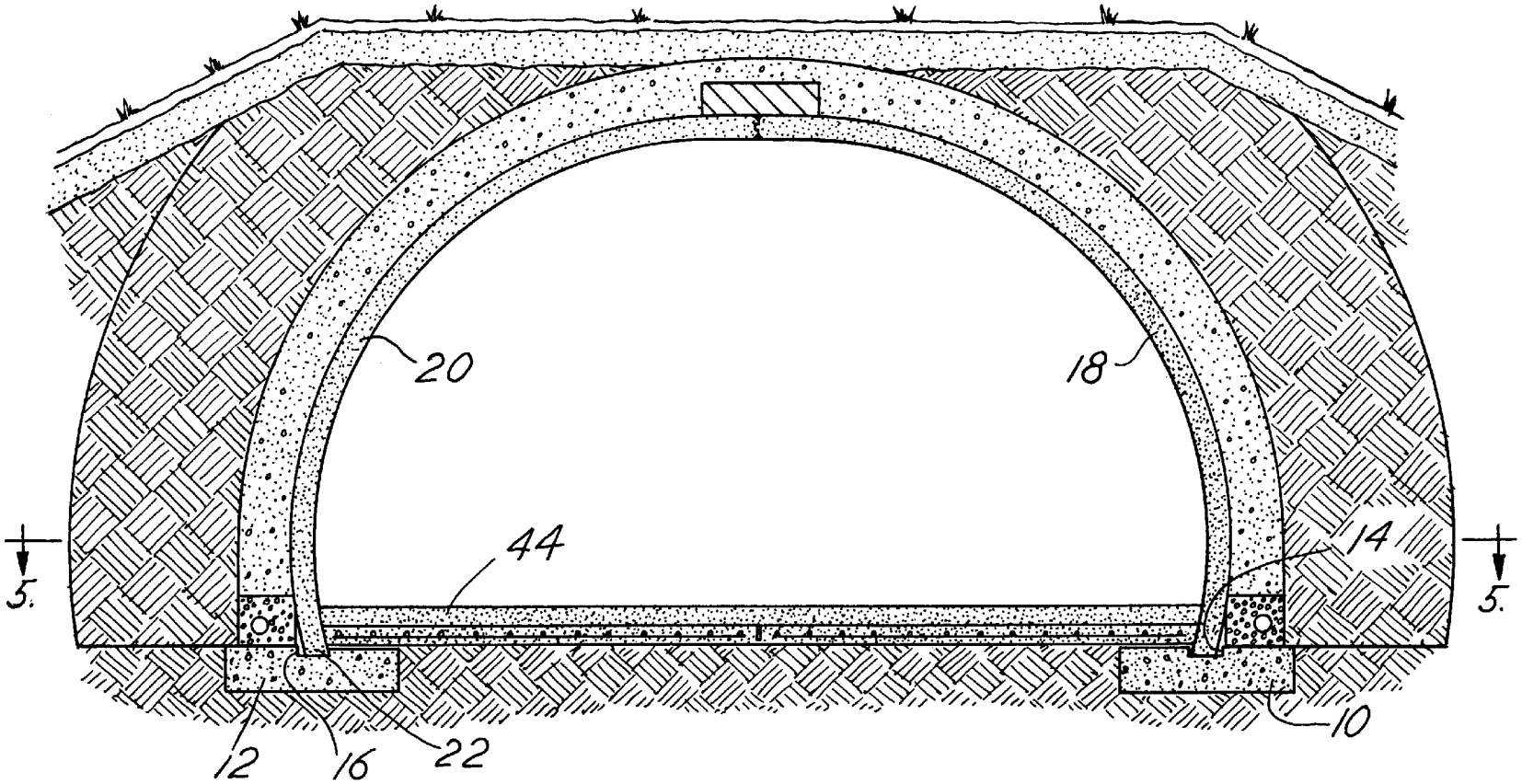
FIG. 4 is a cross sectional view of the bunker construction of FIG. 2 taken along the line 4—4.

A front cast-in-place plate 50 with an opening 52 defining the door passage is provided to define the front end of the bunker enclosure. The door opening or portal 52 may have a steel door or any other type of security door attached thereto. It is noted that the arch elements 18 and 20 form a generally semicircular enclosure and that the front plate 50 is generally rectangular, such as depicted in FIG. 1. Appropriate vents may be provided to the bunker through openings in the arch elements 18, 20 and/or front and back plates 40, 50. The front plate 50 includes opposite sides or vertical edges. The two vertical edges of the cast-in-place front plate 50 are provided with a recessed lip 70 as depicted in FIG. 2 on its backside. During construction of the bunker, the joints between the arch elements 18, 20 will typically be covered with appropriate membrane material 72 to preclude leakage.

Attached to the backside of the panels 58 and 60 are steel reinforcing strips 62 such as depicted in U.S. Pat. No. 4,116,010. Compacted soil 64 is provided to, at least, in part, frictionally encapsulate the reinforcing strips 62. In this manner, a mechanically stabilized earthen structure is built along the front face and sides of the bunker. Reinforcing strips 62 in combination with compacted earth and the associated panels form a mass which enhances the integrity of the bunker construction.

The bunker construction includes compacted soil over the arch elements 18, 20 to enhance the protective capacity of the bunker. The various elements forming the bunker are typically reinforced concrete with reinforcing bars therein. In a preferred embodiment, the reinforcing bars are electrically interconnected to provide the effect of a Faraday Cage so as to avoid discharge of any static electricity in the environment of the bunker enclosure. This electrical discharge protection is primarily accomplished through the crown element 42 and cast-in-place footing blocks 80 which serve to electrically connect component parts of the structure. The cast-in-place footings, e.g. footing 12 include conductive bars, for example, reinforcing bars 82 which are connected with bars, for example, bars 84 in the footing blocks 80. The conductive bars 84 in turn are electrically connected with loops, for example loops 86, projecting out of the outside of the shell or arch element, for example arch element 18. Further, the arch element 18 at the ends thereof include projecting metal loops 88 which again are electrically connected with the reinforcing bars, rods or the like in the pre-cast arches 18. The loops 88 join with and electrically connect with reinforcing bars in the front plate 50. Similarly, the back plate 40, as well as the floor 44, all include a grid of conductive bars, rods or wires which connect with bars, rods or mesh in the other component parts. A series of rods 90 likewise is provided in the crown element 42 and metal rod loops 91 extend from the crown element to provide a continuous electrical connection between all of the wire mesh elements retained in the component parts forming the bunker enclosure. Thus, in essence, a wire mesh cage surrounds the bunker enclosure. That wire mesh cage is then grounded to preclude generation of a spark which might ignite the contents of the bunker and to counteract the activity of lightning or other electrical activity in the environment.

It is possible to alter the construction in various ways without departing from the scope of the invention. For example, the shape and contour of the arch elements may be varied.

Thus, the invention is to be limited only by the following claims and equivalents thereof.

What is claimed is:

1. A bunker construction comprising, in combination:

a series of generally curved, precast concrete arch elements, each arch element having a top end, a bottom end and generally parallel, spaced side surfaces;

a footing with an elongate depressed key way for receipt of the bottom end of the arch elements;

a second footing generally parallel to and spaced from the first footing, said second footing also including an elongate depressed key way generally parallel to the first footing elongate key way for receipt of the bottom end of the arch element;

a series of cast-in-place footing blocks which interconnect the reinforcement bars of the arch elements with the reinforcement bars of the two footings;

pairs of the arch elements having their top ends abutting along a crown line generally parallel to the footing channels with the bottom ends of each arch element positioned in a footing channel, said pairs of arch elements arranged side by side to form a generally semicircular roof of an enclosure;

a vertical back plate forming a back side of the enclosure;

a vertical front plate forming the front side of the enclosure, said front plate having first and second lateral sides;

a plurality of precast panels, each panel having a back side, said panels arrayed as extensions of the lateral sides of the front plate;

a plurality of mechanically stabilizing elements attached to the back sides of the precast panels; and compacted soil, at least in part, frictionally engaging the compacted soil, said compacted soil entombing, at least in part, the arch elements and forming a mechanically stabilized structure over the enclosure.

2. The bunker construction of claim 1 wherein the side surfaces of engaged arch elements form a semicircular shape end one offset laterally.

3. The bunker construction of claim 1 further including a cast in place crown element over the top ends of the engaging arch elements.

4. The bunker construction of claim 1 wherein the plate elements are reinforced concrete including reinforcing bars.

5. The bunker construction of claim 4 wherein the reinforcing bars are electrical conductors, and wherein the bars are electrically connected and grounded.

6. The bunker construction of claim 1 wherein the front plate includes a door passage to the interior of the bunker.

7. The bunker construction of claim 1 wherein the top ends of engaging arch elements include cast in place metal plates.

8. The bunker construction of claim 6 wherein opposed metal plates are formed as a cooperating male and female shape.

9. The bunker construction of claim 1 further including a floor plate between the footings.

10. The bunker construction of claim 1 wherein the opposed arch elements are generally in the form of one quarter, quasi semicircular elements.

11. The bunker construction of claim 1 further including conductibe metal members in the component parts of the bunker construction electrically connected to provide a Faraday Cage about the enclosure defined by the bunker construction and grounded.

* * * * *

UNITED STATES PATENT AND TRADEMARK OFFICE

CERTIFICATE OF CORRECTION

PATENT NO. : 6,205,717 B1
APPLICATION NO. : 09/547219
DATED : March 27, 2001
INVENTOR(S) : John S. Shall et al.

It is certified that error appears in the above-identified patent and that said Letters Patent is hereby corrected as shown below:

Please revise Claim 1, column 4 starting with line 58 through line 61. Insert the following revised language compacted soil, at least in part frictionally engaging the mechanically stabilizing elements, said compacted soil entombing, at least in part, the arch elements and forming a mechanically stabilized structure over the enclosure.

Revise Claim 2 column 4, lines 62-63
The bunker construction of claim 1 wherein the side surfaces of engaged arch elements forming a semicircular shape are offset laterally.

Signed and Sealed this

Twenty-ninth Day of January, 2008

JON W. DUDAS
*Director of the United States Patent and Trademark Office*